United States Patent [19]

Owen

[11] Patent Number: 4,690,064

[45] Date of Patent: Sep. 1, 1987

[54] SIDE-MOUNTED MONORAIL TRANSPORTATION SYSTEM

[76] Inventor: William E. Owen, 481 S. Keeler Woods Dr., Marietta, Ga. 30064

[21] Appl. No.: 865,022

[22] Filed: May 20, 1986

[51] Int. Cl.[4] ..... E01B 25/08; B61B 13/04; B61C 13/04

[52] U.S. Cl. ..... 104/119; 105/144; 105/348; 105/453; 52/726; 104/124; 104/35; 104/28

[58] Field of Search ..... 104/118, 119, 89, 121, 104/124; 105/141, 144, 148, 343, 348, 147; 52/726, 729

[56] References Cited

U.S. PATENT DOCUMENTS

| | | | |
|---|---|---|---|
| 1,431,536 | 10/1922 | Maloney | 104/119 |
| 3,122,105 | 2/1964 | Scherer | 105/147 |
| 3,245,355 | 4/1966 | Cousins et al. | 105/147 X |
| 3,606,839 | 9/1971 | Stafford et al. | 104/119 |
| 3,890,904 | 6/1975 | Edwards | 104/121 |
| 3,942,450 | 3/1976 | Elorza | 104/121 |
| 3,985,081 | 10/1976 | Sullivan, II | 104/23.2 |
| 4,000,702 | 1/1977 | Mackintosh | 104/244 |
| 4,152,992 | 5/1979 | Mackintosh | 104/130 |
| 4,338,863 | 7/1982 | Tauzin | 104/89 |
| 4,394,837 | 7/1983 | Edwards | 104/28 |
| 4,503,778 | 3/1985 | Wilson | 104/119 X |

FOREIGN PATENT DOCUMENTS

| | | | |
|---|---|---|---|
| 2248183 | 6/1975 | France | 104/121 |
| 0626692 | 10/1961 | Italy | 104/118 |
| 0810538 | 3/1981 | U.S.S.R. | 104/121 |

*Primary Examiner*—Robert B. Reeves
*Assistant Examiner*—Scott H. Werny
*Attorney, Agent, or Firm*—Cushman, Darby & Cushman

[57] ABSTRACT

A monorail beam is provided with a lower, upwardly-facing support surface, a lower, laterally-facing support surface and an upper, medially-facing support surface (relative to the support beam). Vehicles are hangingly supported, pendulum-like, from davit-like cantilevering arms of support trucks having wheels which run on or act against the base support surfaces so that they run along the side or sides of the beam. The beam may be elevated on columns, surface mounted, or depressed in tunnels. By preference, the vehicles' bodies are detachable from the trucks, and the heaviest air-conditioning components are mounted on the trucks rather than on the bodies. Power transmission and automatic control systems are described, as are switching systems and station facilities.

17 Claims, 12 Drawing Figures

SIDE-MOUNTED MONORAIL TRANSPORTATION SYSTEM

BACKGROUND OF THE INVENTION

In recent years, interest in providing light rail-type mass transit in urban and suburban areas, between adjacent pairs of cities, between cities and satellite service facilities such as outlying airports, sports stadia and the like has increased.

Often the feasibility of providing or extending such a transit system fundamentally hinges on cost.

Although some cities, such as San Francisco, Calif., Washington, D.C. and Baltimore, Md. were successful in initiating construction of their light rail urban mass transit systems at a time when a combination of cost factors worked in their favor, those same conjunctions of favorable factors do not presently exist: federal government funding assistance is not so forthcoming, energy prices are at least temporarily in decline, right of way land acquisition costs and construction costs have risen, and car fabrication plants have closed down domestic production lines.

Yet the need of many for convenient light rail-type mass transit goes unmet. It is clear that if more of such mass transit systems are to be built, some innovations are needed.

SUMMARY OF THE INVENTION

A monorail beam is provided with a lower, upwardly-facing support surface, a lower, laterally-facing support surface and an upper, medially-facing support surface (relative to the support beam). Vehicles are hangingly supported, pendulum-like, from davit-like cantilevering arms of support trucks having wheels which run on or act against the beam support surfaces so that they run along the side or sides of the beam. The beam may be elevated on columns, surface mounted, or depressed in tunnels. By preference, the vehicles' bodies are detachable from the trucks, and the heaviest air-conditioning components are mounted on the trucks rather than on the bodies. Power transmission and automatic control systems are described, as are switching systems and station facilities.

The principles of the invention will be further discussed with reference to the drawings wherein a preferred embodiments is shown. The specifics illustrated in the drawings are intended to exemplify, rather than limit, aspects of the invention as defined in the claims.

DETAILED DESCRIPTION

Figure 1:
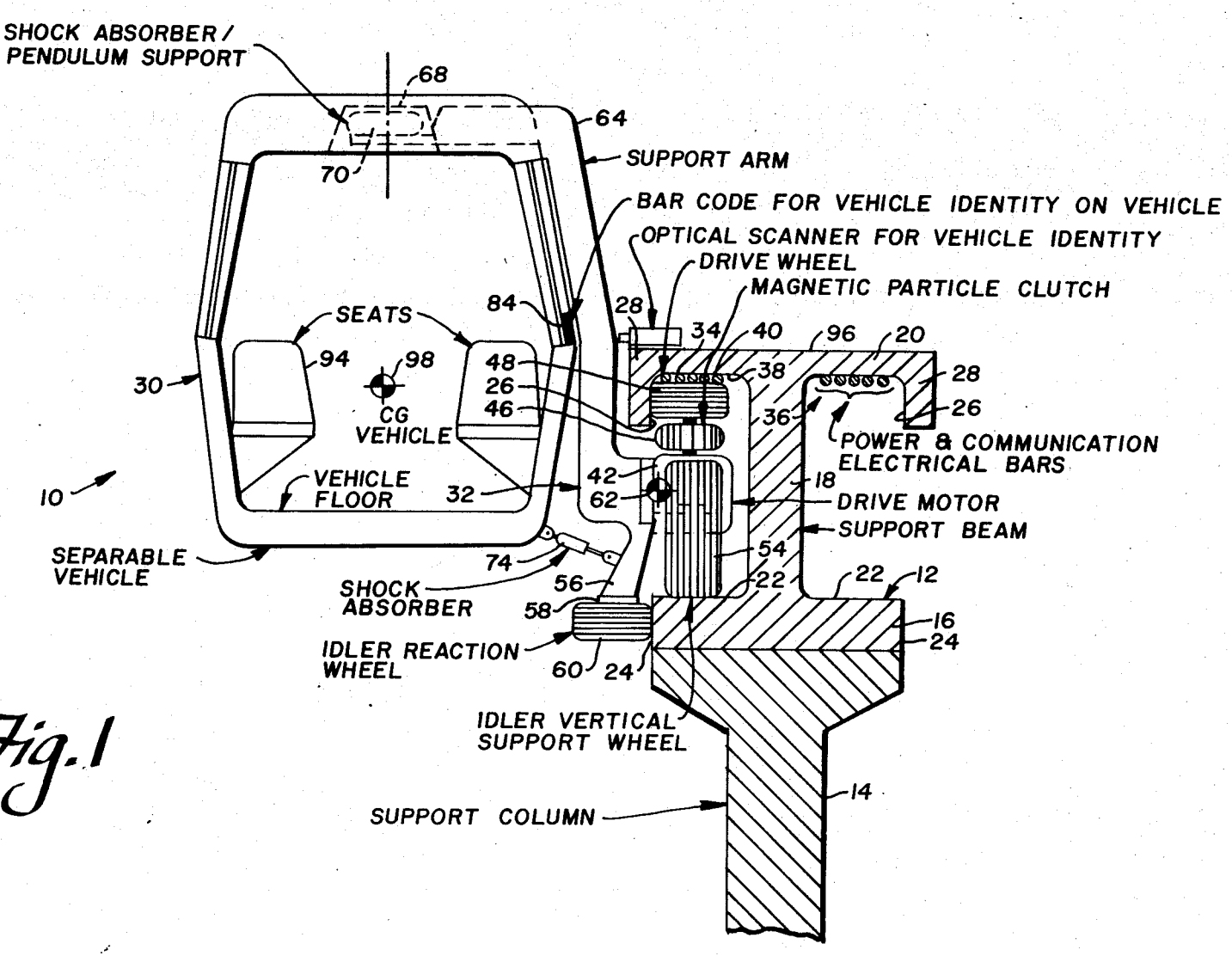
FIG. 1 is a fragmentary vertical transverse cross-sectional view of a side-mounted monorail transportation system embodying principles of the present invention.

A key element of the side-mounted monorail support system 10 of the present invention is the system of support beams, a representative one of which is shown at 12 in vertical transverse cross-section in FIG. 1. Although the beam 12 typically would be supported on columns 14 (or pylons, towers, masts, frameworks or the like) at a level that is elevated above ground level, in order to minimize the width of right-of-way needed, and in order to minimize interference of ground-supported vehicles, people, animals and obstacles with the running of the cars, it is within the purview of the invention to mount the beams 12 in some parts of the system on suitable foundations at ground level, or on a track bed below ground level e.g. in a tunnel, tube or cut whether or not covered over by earth or other material.

As a problem in semantics, although the preferred term for the element 12 is a support beam, it would not be wrong to call it a rail or a track, or a section of or a length of a beam, rail or track. The support beam 12 is of indeterminate length. In practice, some sections or lengths of it may be but a few feet long, others may be miles long, or, conceivably, a system could be provided in which the support beam 12 is a seamless, integrally formed unit. Whether the fixed path-providing means is sectional or integral and, if sectional, what length(s) the sections have is of little importance to the broad principles of the present invention. Typically, the support beams 12 and columns 14 are made of steel rebar-reinforced concrete such as is conventionally used in the manufacture of monorail track systems, electrical utility power distribution line support pylons and the like.

For convenience in description, the path of indeterminate length provided by one or more sections of beam 12, suitably supported on the ground in end-to-end relation as a continuing series, will sometimes be referred to herein as a beam 12, without any implication being intended that such structure is monolithic or is constituted entirely by one section, unless such an interpretation would clearly be contrary to the particular passage of the text.

The beam 12 is shown being double-sided, in that it is constructed and adapted to provide two parallel paths, one spaced laterally to the left of and the other spaced laterally to the right of the imaginary vertical plane containing its longitudinal centerline, a plane about which the left and right halves of the beam are symmetrical, in the preferred embodiment. Whereas more details are given for one side, it should be assumed that, by preference, the other side is the same. In a less-preferred, but possible construction, the other side may be different, or it may be omitted.

In the preferred embodiment illustrated, the beam 12, in transverse cross-sectional figure has a T-shape, complete with serifs on its standard and arms. That is, the beam 12 is shown including a generally horizontal base plate, foot or flange 16, a generally vertical standard or web 18 medially footed on the base plate 16, and a cap or head plate, flange or cross-arm member 20.

With respect to the path provided by the left half of the support beam 12 shown in FIG. 1, there are three notably important support surfaces, namely the lower, upwardly-facing support surface 22 provided on the upper side of the base plate 16, a lower, laterally-facing support surface 24 provided on an outer end of the base plate 16, and an upper, medially-facing support surface 26 provided on a depending serif 28 provided at the lateral extreme of the head plate 20.

The base plate 16 may stand on and/or be securely mounted to any underlying structure on which it is supported from the ground e.g. via a foundation. Typically, the base plate 16 and head plate 20 are equal in width, and the head plate 20 typically is wide enough to provide an emergency escape route for persons to walk on after they have left a disabled transit car through an opened emergency hatch e.g. a car window or roof hatch.

Another fundamental unit of the system 10 is a transit car 30. In the preferred embodiment, the transit car 30 is a passenger car, although it would be within the contemplation of the invention for passengers to be accompanied by their belongings, by luggage, and the same or other cars to be outfitted for transporting freight, livestock, mail, produce and virtually every being, thing or substance heretofore, now or hereafter transported by railroad train, airplane, ship or other mass transit vehicle. A transit car 30 outfitted for carrying mainly passengers is shown by way of exemplification.

By preference, each transit car 30 is mounted to the support beam 12 for transit therealong by at least one, preferably two, and permissibly more than two trucks 32 of believed-novel construction. (If only one truck is provided for a relatively small car, some additional guide means are needed for serving the function of maintaining the car running parallel to the beam 12 that is provided by the second truck when two trucks spaced longitudinally from one another support a car 30 from the beam 12.)

Figure 2:
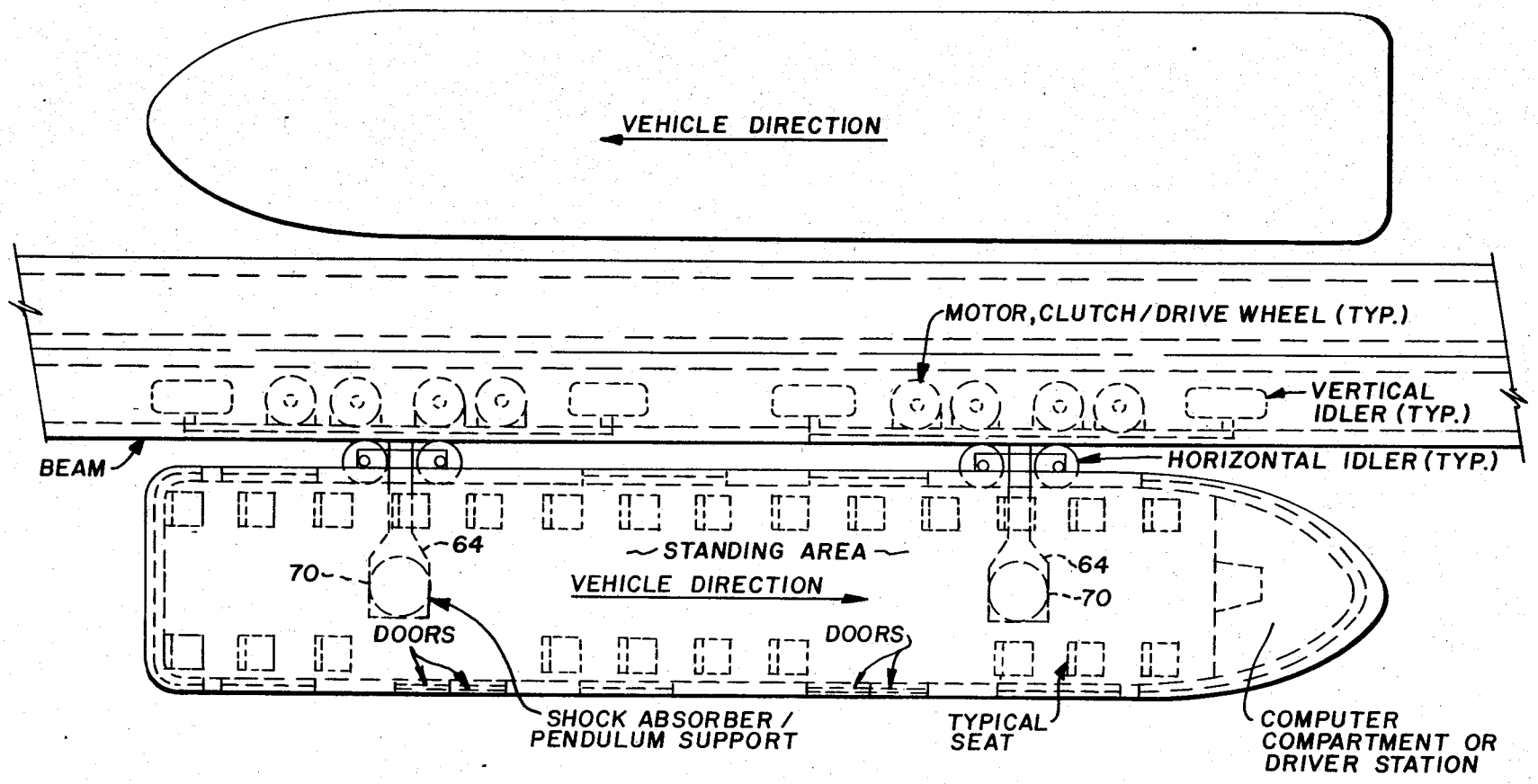
FIG. 2 is a fragmentary top plan view thereof.
Figure 3:
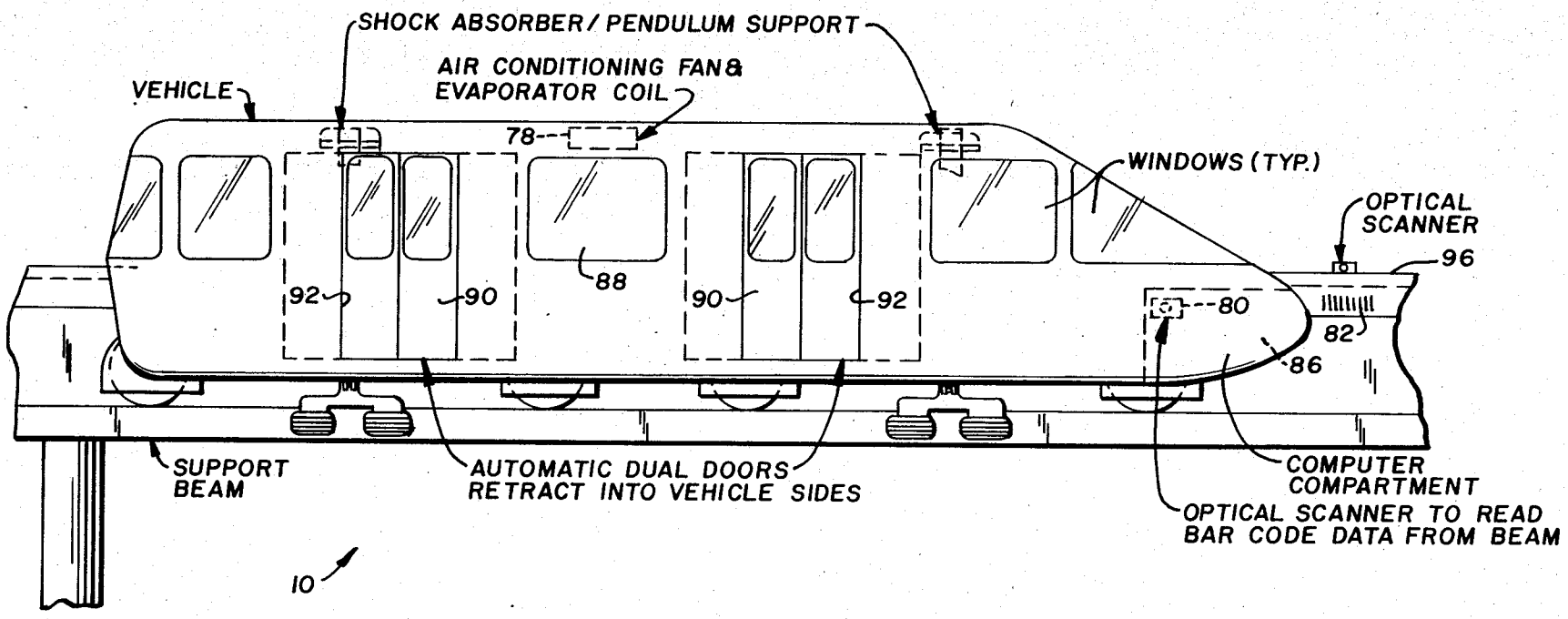
FIG. 3 is a fragmentary side elevational view thereof.
Figure 4:
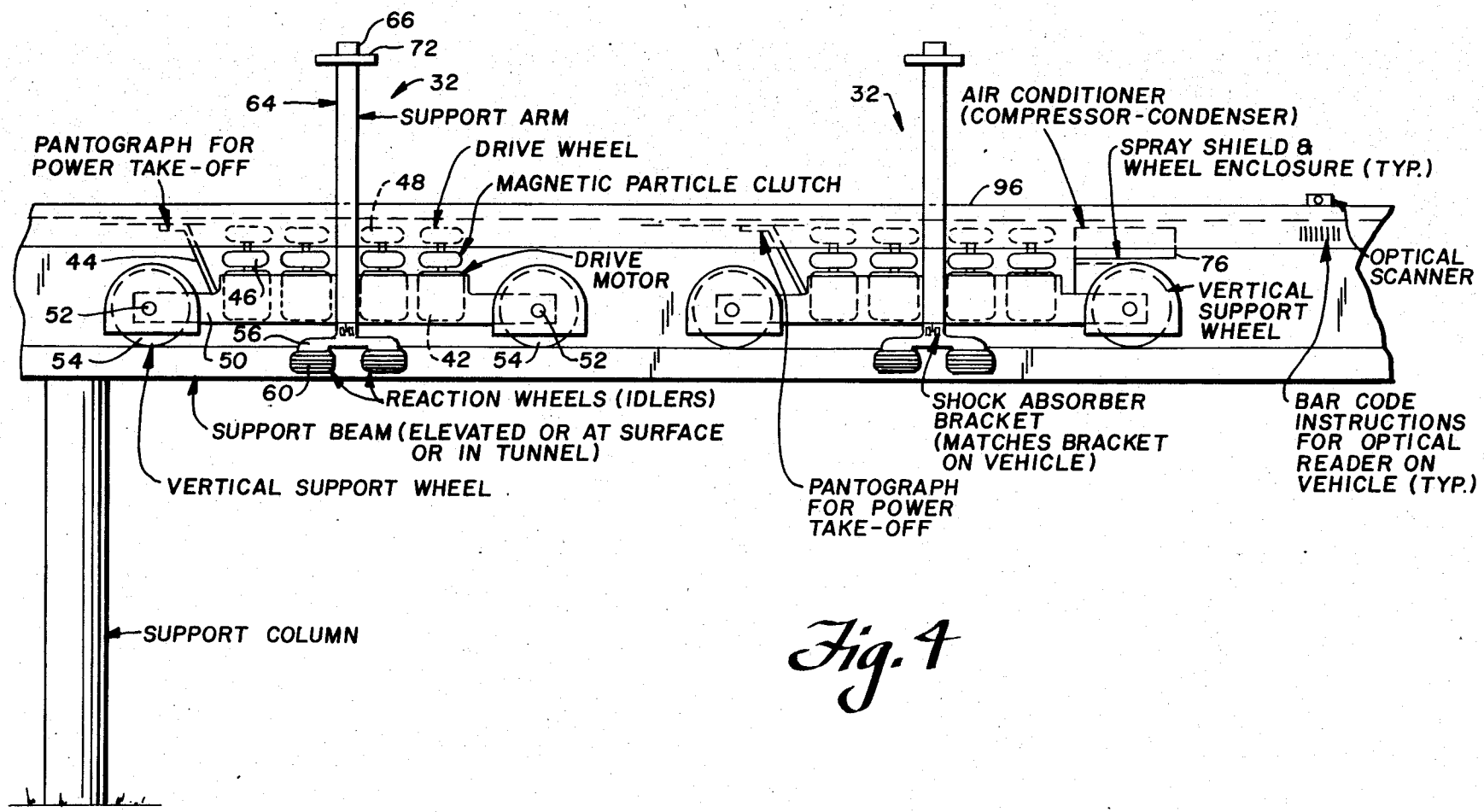
FIG. 4 is a similar side elevational view thereof, with the vehicle body removed from the trucks.

In FIG. 1, a good portion of one of the trucks 32 is shown; parts of two of the trucks 32 are shown in FIG. 2, but a vertically intermediate part of each is omitted, because it is obscured by the car body, and only the pendular attachments are suggested by dashed lines. The body of the car 30 is omitted in FIG. 3, partly as a reminder that by preference, the car body is detachable from the trucks, and partly in order to be able to show or indicate more of the structure of the trucks 32 of the preferred embodiment in this Figure. More of the truck structure is suggested in FIG. 4, from above.

Although all of the trucks 32 are identical, and are all used for driving, in some instances the trucks may be alternately powered, or some may be motorless guides.

Although a sole transit car is shown providing a complete transportation unit, in practice one, two or more like cars, conventionally hitched together may provide a train of cars.

In instances where a car or a train is made up of two or more powered trucks 32, conventional control means may be used for coordinating the application of power and braking so that there is no tendency to excessively tension or buckle a car or train by uneven application of power or brakes.

In the preferred embodiment, the motive power for the transit cars is electrical power, in the form of d.c. electrical current supplied along the support beam 12, e.g. through one or more conductors 34 secured on the underside of the respective arm of the head plate 20, so as to be sheltered and protected by the beam shape 18/20/28 which, in effect, represents a downwardly opening groove 36, the surface 38 of which is the base thereof. (Other conductors, 40, for distribution of communications and control signals may be mounted to the beam 12, e.g. in the groove 36 alongside the electrical conductor or conductors 34.)

Each truck 32 is shown provided with at least one known type of electrical drive motor 42 which is served with electrical power by a suitable circuit including a pantograph 44 with a contact pressed against the conductor or conductors 34. By preference, the output shaft means of each motor 42 incorporates a clutch/-brake mechanism, e.g. a magnetic particle clutch 46 which serves a respective vertical axis drive wheel 48, suitably tired, e.g. by a known rubber-tired subway drive wheel.

The electric motors 42 are mounted on a truck frame 50, e.g. as a line of four such motors, oriented output shaft upwards. The truck frame 50 further is shown having fore and aft horizontal axis transversally extending axles 52 mounting respective non-drive (idler) vertical support wheels 54. A centrally located downwardly bifurcated spur portion 56 of the truck frame 50 provides two, in-line vertical axis axles 58 mounting respective non-driven (idler) reaction wheels 60.

In the instance depicted in FIG. 1, which is preferred, the truck center of gravity 62 is located outboard of the vertical support wheels 54, relative to the beam 12, vertically on line with the respective edge of the base plate 16, just above the axles 52, and the axles 58 lie slightly further outboard, again relative to the beam 12.

As shown, the powered wheels 48 are in tractive engagement with the respective beam surface 26, the vertical support wheels 54 are in rolling engagement with the respective beam surface 22, and the reaction wheels 60 are in rolling engagement with the respective beam surface 24. Overlying the spur portion 56 of the truck frame 50, a transit car support arm 64 is footed on the frame 50 and arches or cantilevers upward and outward (relative to the beam 12) ending in a car-support fulcrum means 66.

The transit car 30 is shown being pendularly suspended by means of appropriate supports 68 from the fulcrum means of two such support arms 64.

A shock absorber 70, which may be a toroidal compressed gas-filled pillow-like or bellows-like member of a commercially available type, is shown provided about the fulcrum for reaction between opposed arm and car surfaces 72 to damp vertical bumping motion and some swinging motion. In addition, a linear shock absorber 74 for damping swinging motion is shown mounted between the body of the transit car 30 and spur portion 56 of the truck frame 50. Communication and control lines (not shown) may extend on or in any of the trucks and support arms to the vehicle body, or be otherwise connected between the conductors 34 and/or 40 and on-board systems and elements.

By preference, the heavy parts of the air-conditioning system for the transit car interiors, e.g. the compressor/condenser equipment is carried on the trucks 32, e.g. at 76, with suitable fluid conductor lines (not shown) running between it and one or more air-conditioning fan/coil units 78 mounted on-board the body of the transit car. These lines may follow the power, communication and control lines, i.e. in the same umbilical (not shown), or be separated therefrom and/or be provided with any degree of redundancy and/or armoring and shielding thought necessary.

The bodies of the transit cars preferably are utterly disconnectable from the trucks 32, by simple demounting of the car bodies from the fulcrum means 66 and disconnection of suitable connectors (not shown) provided on the power/communication/control line umbilical(s).

The transit system 10 and its cars may be provided with any of the features which have come to be conventional on modern mass transit systems including the use of on-board optical scanners 80 to read bar codes 82 on the beam 12, on-board bar codes 84 to be read by beam-mounted optical scanners, any of these being tied into a state-of-the-art command and control system using on-board computer equipment 86, off-board computer equipment (not shown) located at a central and/or regional control center, all with whatever manual control overrides for an on-baord operator as are desired or thought to be necessary.

The car 30 is shown typically provided with windows 88, automatic dual doors 90 slidingly retractable into the vehicle sides at opposite margins of door openings 92, with passenger seats 94, a vehicle floor, preferably located near, and not far below the center of gravity of the trucks. The preferred juxtaposition of beam and car is such that the lower edges of the windows are slightly above or are flush with the emergency walkway surface 96 provided on the head plate of the beam 12. The center of gravity for the vehicle preferably is relatively low, the preferred location being indicated at 98 in FIG. 1.

Figure 5:
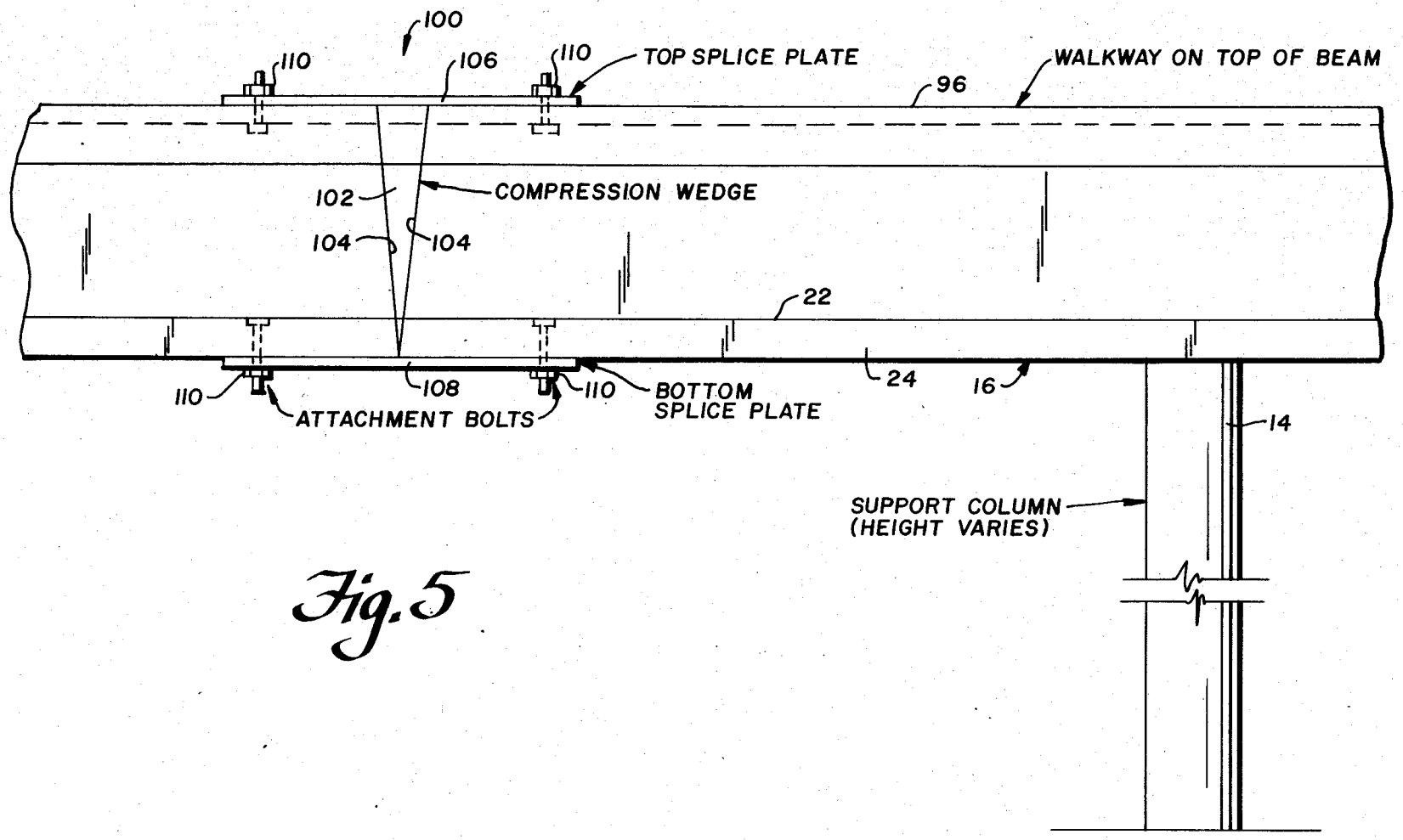
FIG. 5 is a fragmentary side elevational view of the column-supported beam, showing a typical preferred splicing arrangement.

For use in instances where the beam 12 cannot be fabricated as an integral unit to the extent of the full length needed, sections thereof may be joined as mutual continuations in an end-to-end relationship, for instance as is illustrated in FIG. 5.

The joint 100 is shown including a wedge 102 having the same profile, when installed, as the beam 12, installed from above to complementarily fill the gap between the oppositely-slanted ends 104 of respective sections of the beam 12. The beam 12 is shown being rigidified at the joint 100 top and bottom by splice plates 106, 108, bolted to the respective flanges 16, 20 of the beam sections by nut and bolt assemblies 110, or equivalent gap-filling, tie and fastener means made of suitable materials.

Figure 6:
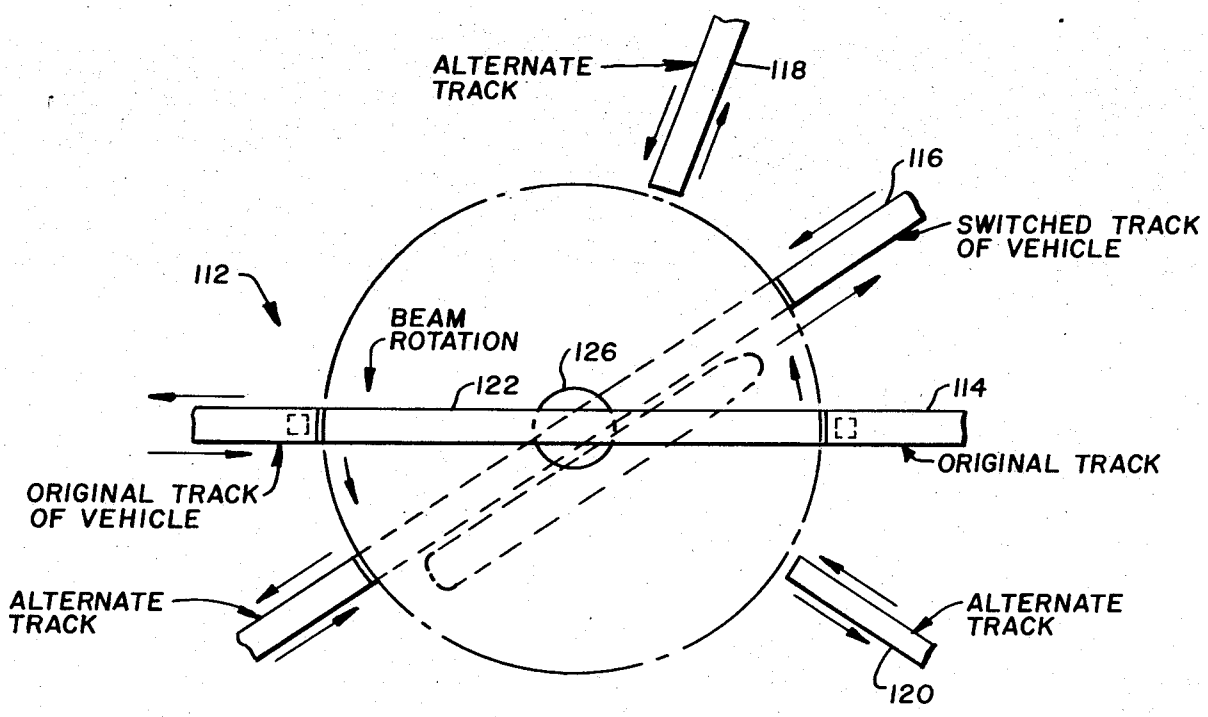
FIG. 6 is a fragmentary top plan view showing a typical preferred round-table-type of switching arrangement.
Figure 7:
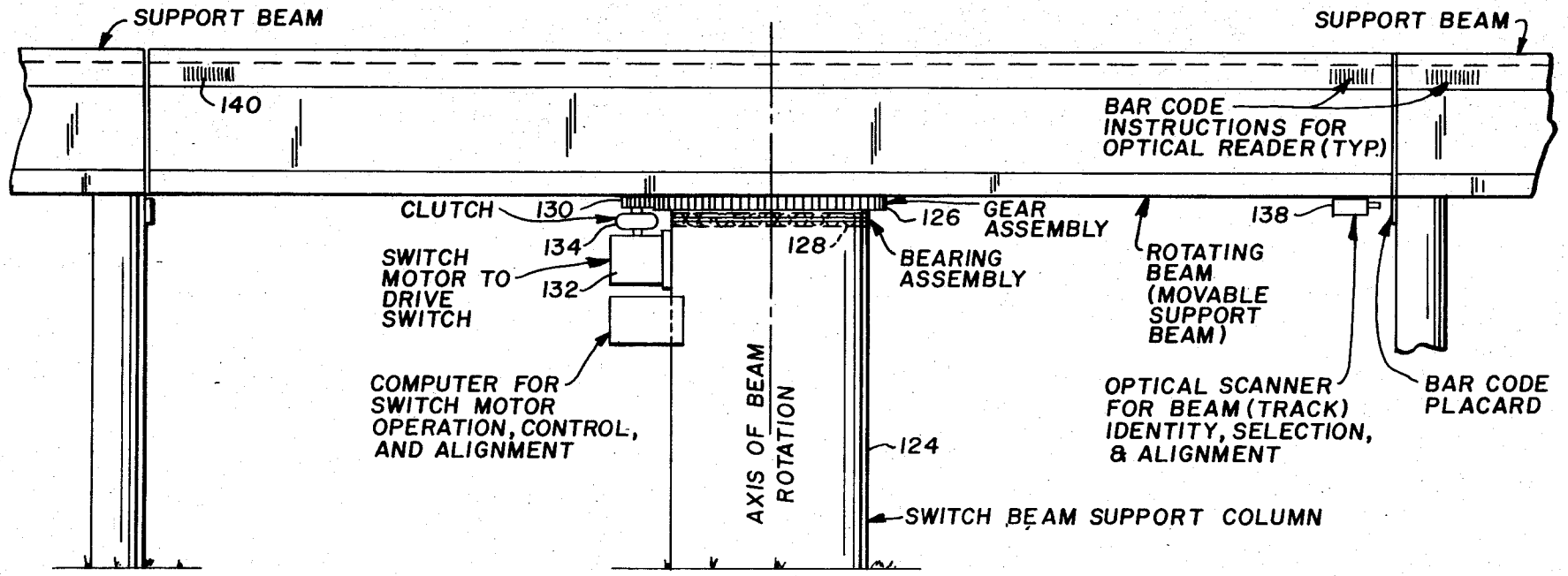
FIG. 7 is a fragmentary side elevational view thereof.

Referring now to FIGS. 6 and 7, a typical switch 112 is shown, e.g. at a place where a first track 114 of beam elements 12 intersects a similar second track 116, from which juncture two other alternative tracks 118, 120 also radiate. At this juncture a section 122 of beam 12 of sufficient length to support a transit car or the longest train of such cars as is to be switched is shown mounted on a vertical-axis turntable structure including a support column 124 surmounted by a turntable in the form of a ring gear 126 which is fixed to the section 122 of beam 12 and journalled by bearing means 128 for rotation on the column 124 about a vertical axis. The ring gear is arranged to be driven by the gear head 130 of an electric motor 132 which is fixed to the column. The motor 132 output is shown including a clutch mechanism 134, which may be similar to that provided for the motors of the drive wheels of the transit cars. A computerized control unit 136 is provided for operating the motor. This unit may be operated by signals from a central station, by an on-board transit car driver and/or computer, and/or by an on-site switchman. The control system for the switch 112 may include state-of-the-art means for ensuring and reporting on switch orientation and operation, such control means, for instance, incorporating optical reading means 138 and bar code means 140 disposed between relatively movable elements and systems.

Figure 8:
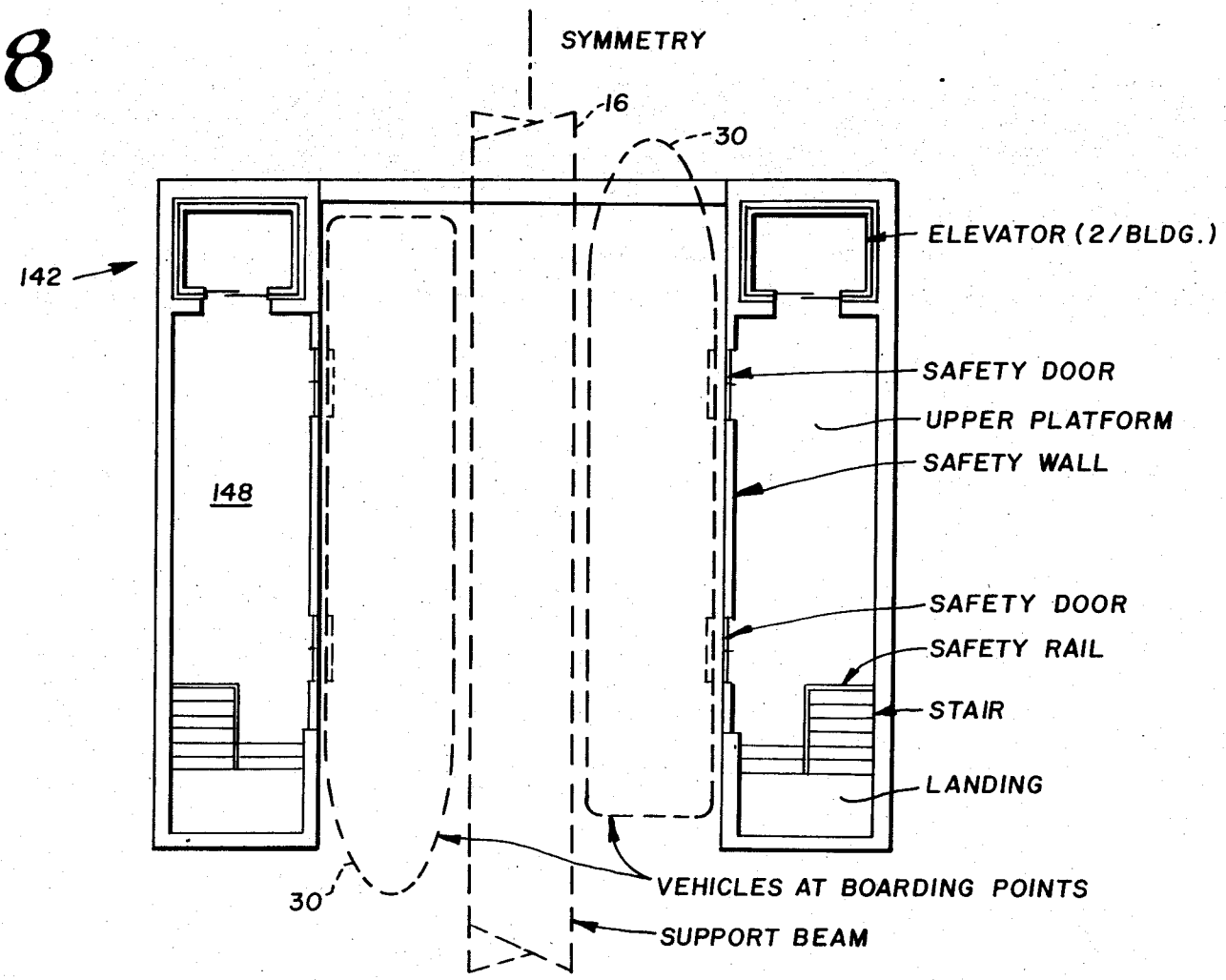
FIG. 8 is a schematic top plan view of the upper floor of a typical preferred station for the side-mounted monorail transportation system.
Figure 9:
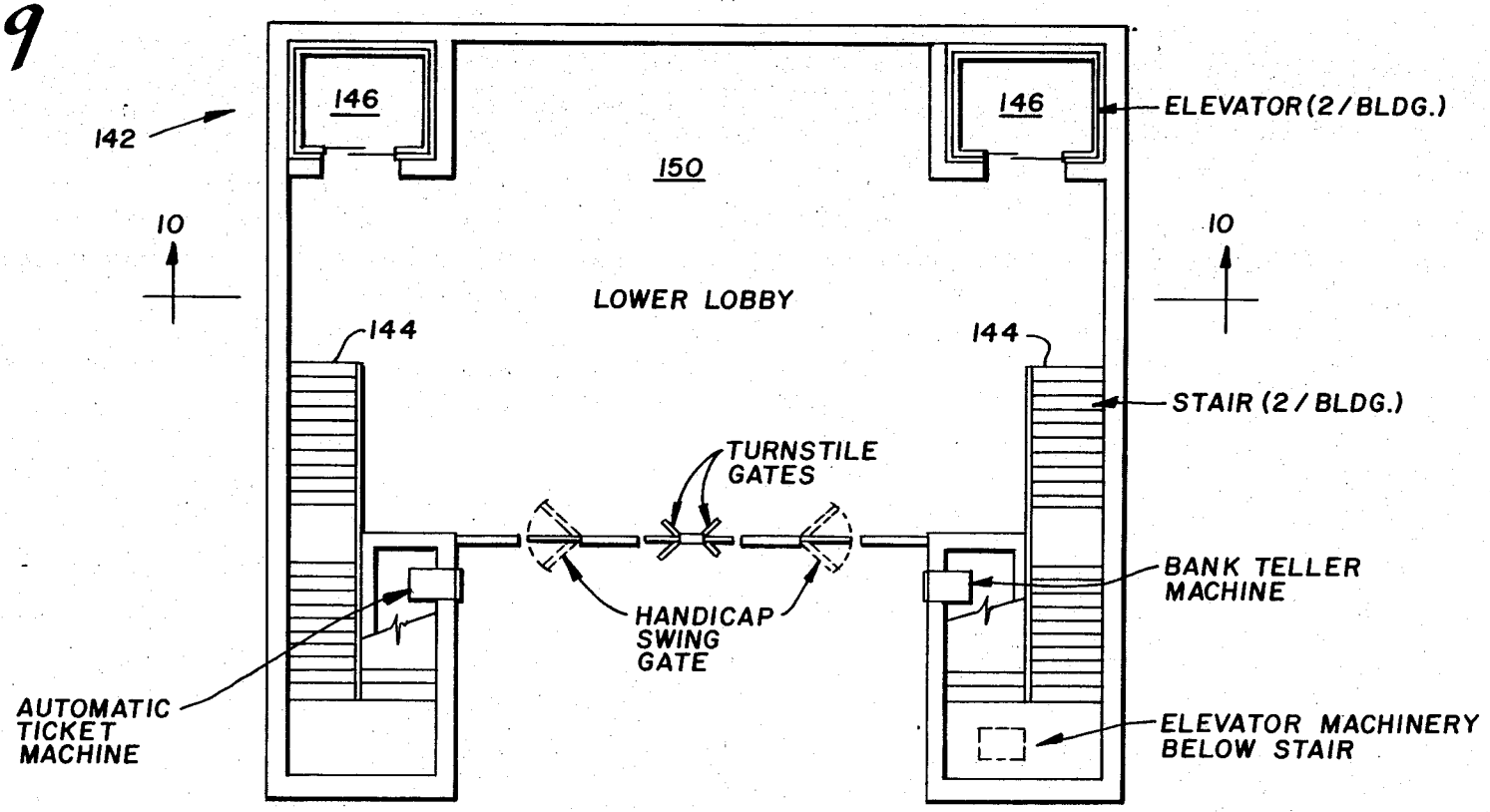
FIG. 9 is a schematic top plan view of the lower floor thereof.
Figure 10:
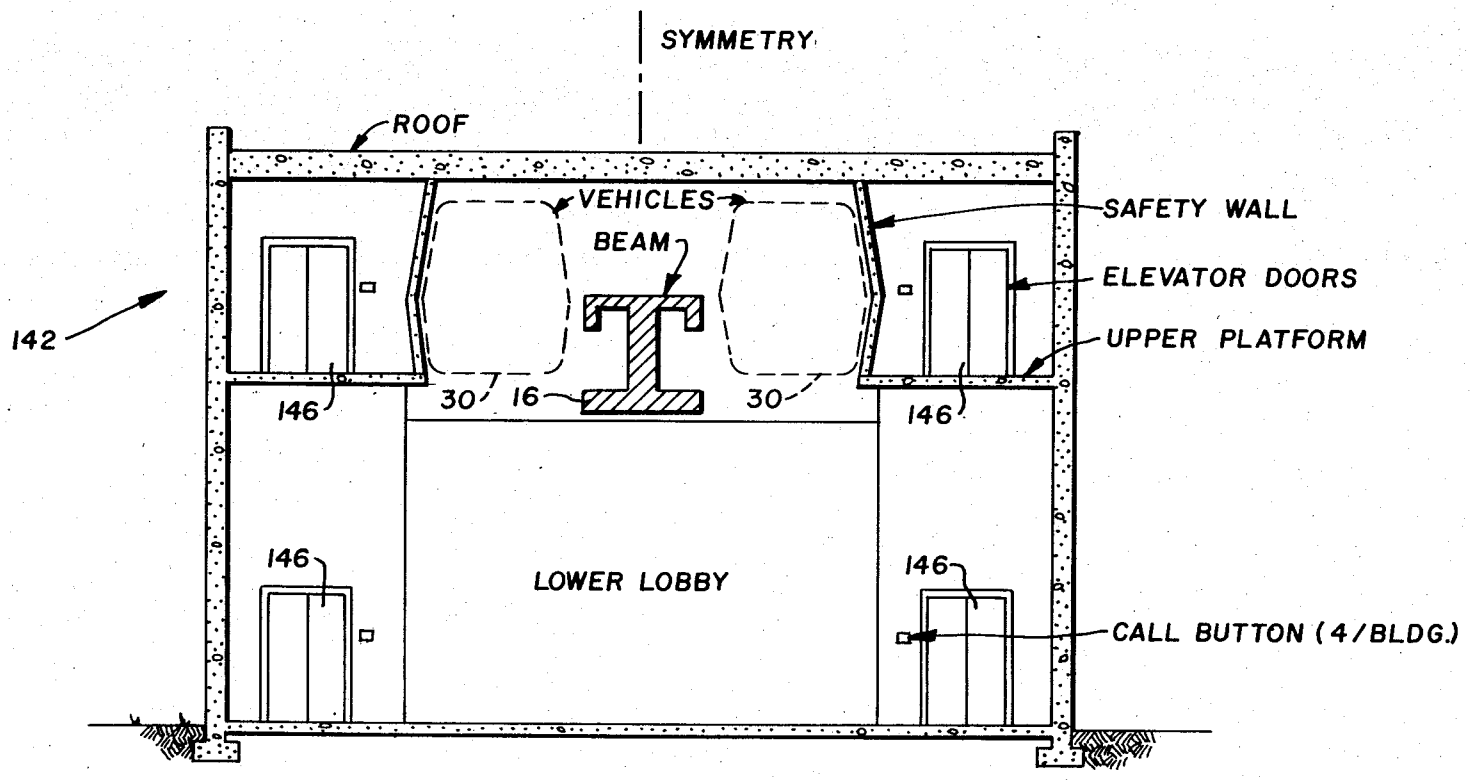
FIG. 10 is a vertical transverse cross-sectional view thereof taken on line 10—10 of FIG. 9.
Figure 11:
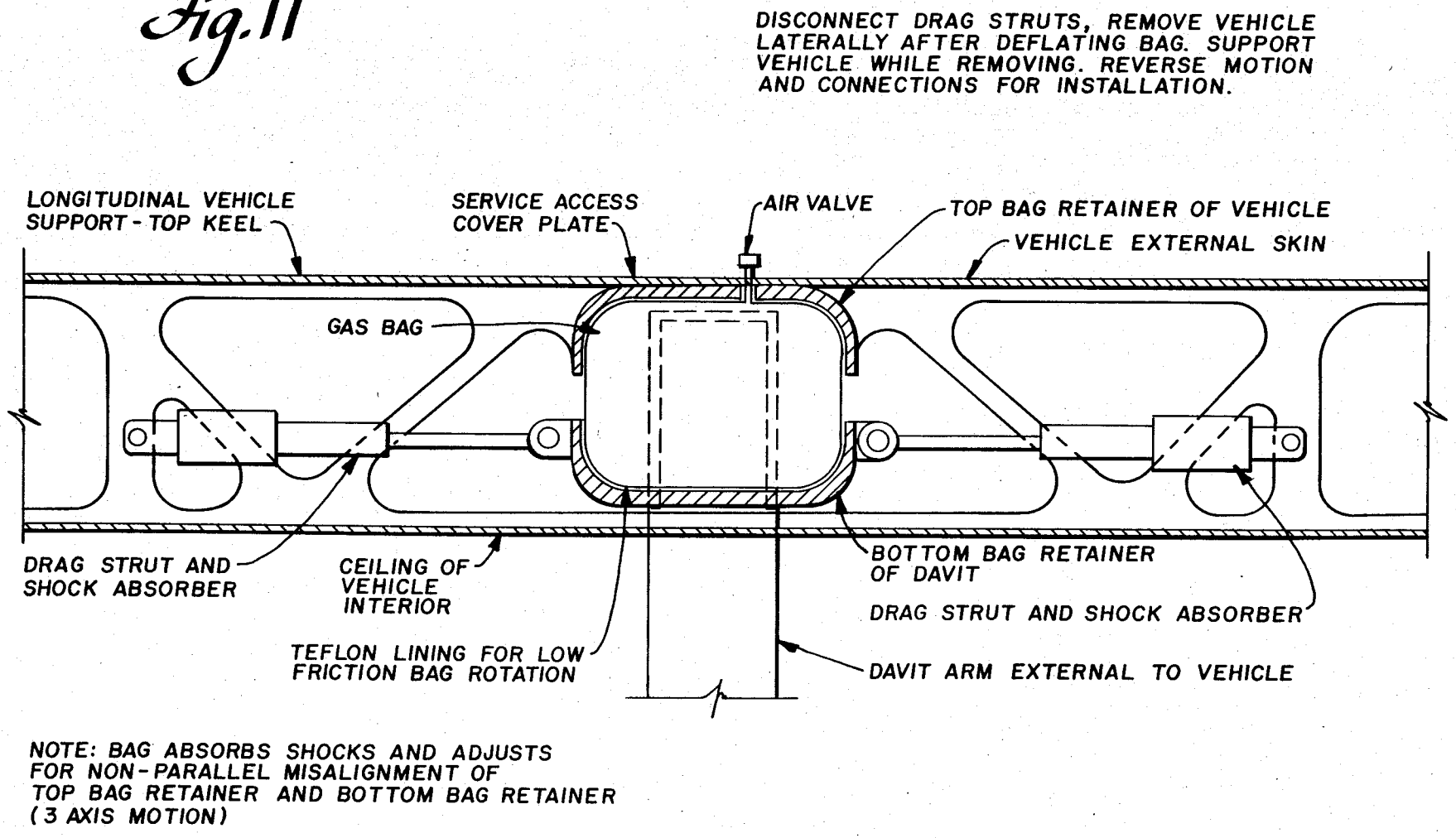
FIG. 11 is a fragmentary enlarged longitudinal scale cross-sectional view of a typical preferred car body/-support arm pendular connection.
Figure 12:
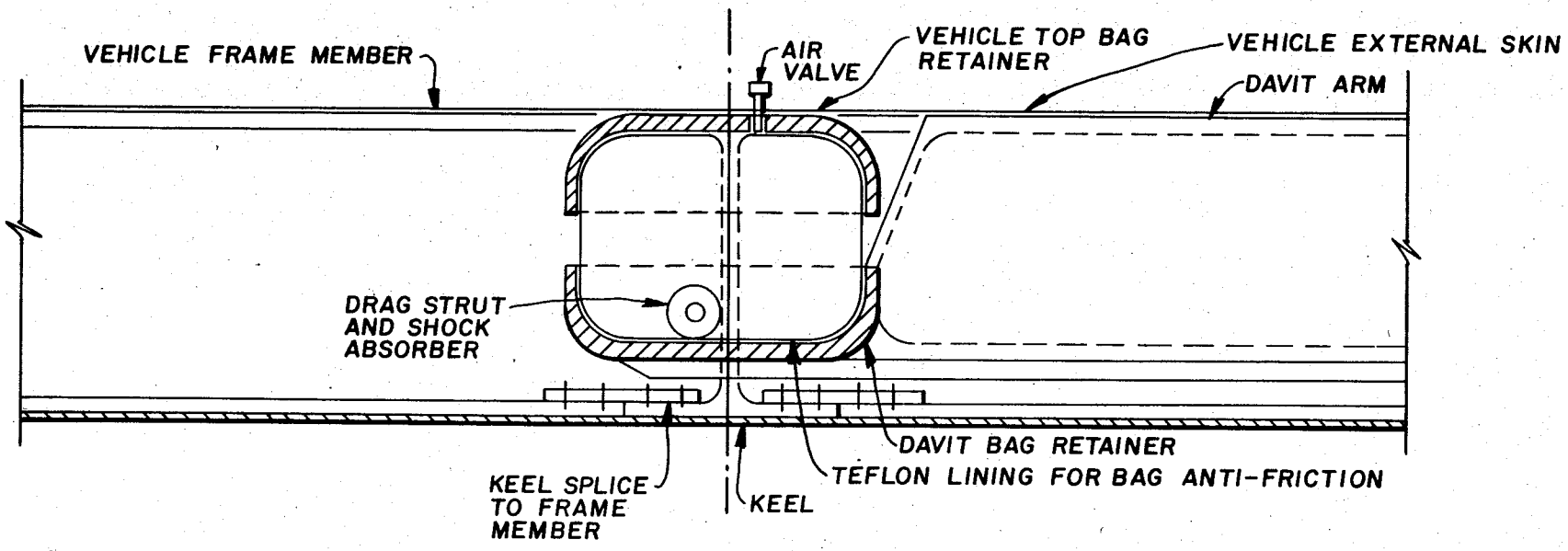
FIG. 12 is a fragmentary enlarged scale transverse cross-sectional view thereof.

A typical station 142 for the transit system 10 is shown in FIGS. 8, 9 and 10. The location of the beam 12 is suggested in dashed lines in FIG. 8 which depicts an upper level for the station, and the presence of two transit cars on parallel tracks on the same beam is suggested by dashed lines in FIGS. 8 and 9. As indicated, by preference, the access doors for the transit cars are provided on the outboard sidewalls of the cars, i.e. on the sides which face away from the beam 12. Accordingly, full height doors are possible, with door sills flush with transit car floor levels. Each station is shown typically provided with stair 144 and elevator 146 access between upper 148 and lower 150 station levels, and other usual station facilities.

In the preferred embodiment, the transit system of the present invention provides a general arrangement of a vehicle, drive assemblies, and monorail beam where (a) the vehicle and the drive assemblies are separable; (b) two or more drive assemblies allow for freely moving along a beam with articulation around points of support within the separable vehicle body; (c) drive assemblies weights are principally supported by the beam without (or with minimum) torsional moments; (d) the air conditioning equipment is mounted on the drive assembly rather than the separable vehicle; (e) the drive wheels are driving on a surface protected from rain, sleet, or snow; (f) the means of propulsion may be rotating electric motors, linear induction motors, hydraulic motors, steam engines, internal combustion engines, jet engines, rocket engines, or nuclear power engines or a combination of such means; (g) braking may be by conventional means of friction devices and/or by means of locked drive shafts and electromagnetic particle clutch engagement.

In the preferred embodiment, the transit system of the present invention further provides a vehicle with (a) interior seating and open standing areas; (b) clear vision around the entire vehicle; (c) fully automated controlled operation or driver controlled operation; (d) optical scanning and interpreting devices (such as laser bar-code readers or universal product code readers or any other type of optical or proximity code device such as magnetic codes or magnetic loop sensors or radio transmitted codes) for speed control data input and automatic position reporting input; (e) on-board computer to provide programmed speed and operation instructions to motor controllers, doors, announcements, environmental system control, location reporting, and security and safety information reporting to a central location, with data from scanning devices which would read information such as speed instructions on certain sections of road beam when approaching a station, or for acceleration instructions when leaving a station.

Further, in the preferred embodiment, the transit system includes a transit car support system in which (a) each vehicle hangs as a pendulum from two or more supports (arms extending from drive assemblies) in order to provide a vehicle floor perpendicular to tne motion forces acting on the vehicle and its passengers and thereby provide added comfort; with (b) a cushioned support from the pendulum supports for a softer ride (as with air bags or springs or hydraulic shock absorbers or of any combination); (c) a side shock-absorber snubber system to dampen vehicle swings; (d) motors for driving the system with wheels against a track beam; (e) idler wheels for support and guidance of the system along a beam system; (f) one or more power rolling or sliding take-off devices for transferring electrical power from power bars on the beam system to the drive assembly; (g) rolling or sliding devices for transferring electrical information from the drive assembly to a conductor on the beam system; (h) air conditioning equipment mounted on the drive assembly (and not the vehicle) to minimize the cantilevered weight of the vehicle; (i) and electrical power generating equipment for the purpose of self-sufficiency of the drive assembly and vehicle.

In the preferred embodiment, the trackage is provided in the form of a beam, which generally extends horizontally, but may extend up and down moderate grades of incline and decline, in runs which are continuous or of determinate or indeterminate length, elevated on columns or the like or otherwise supported from the ground above, on or under ground level, for (a) support of a moving vehicle and drive assembly; (b) suspension of a system of electrical power distribution and communication wires or bars beneath a horizontally extended overhanging section on one or both sides so as to protect the wires from rainfall, snowfall, icing, or contact with persons; (c) a route of passenger escape from a side-mounted vehicle by egress from the vehicle window to the top of the beam which would be used as a walkway; (d) a route along the top of the beam for service personnel to a vehicle anywhere on the beam, whether moving or not; (e) a torsion-resistant shape to resist the twisting of a beam during loading forces caused by the passage of a side-mounted vehicle. Such a beam may be made of welded or bolted steel assemblies, or of cast concrete with pre-stressed reinforcing, or of cast concrete with post tensioning reinforcement, or if any combination thereof. The shape of the beam with the overhanging legs supports the driving top wheels to (f) support the forces applied; (g) protect the driving surface between the drive wheels and the beam from weather conditions; and (h) provide rolling and support surfaces for the vertical idler wheels and the horizontal idler wheels as well as provide for braking surfaces when braking is applied to the idler wheels.

The transit system of the preferred embodiment includes a beam splice arrangement for use between ends of adjacent beam sections in the series, for joining the sections to form a continuous rolling surface and supporting structure for the vehicles. The splice arrangement provides for axial (along the length of the beam) as well as torsional connection. A noncompressible wedge inserted between the ends of the beams provides for pre-loading of compression forces within the adjacent beams to reduce the amount if beam deflection across the beam splice.

In the preferred embodiment, a turntable type of switching arrangement is used in which a switching beam is provided with (a) optical or other type scanners to read bar code or universal product code data on vehicles (or any other type of proximity code device such as magnetic codes or radio transmitted codes) to direct the vehicles toward planned destinations or to reverse direction if the vehicle on a beam; (b) an ability to support the entire vehicle and its passengers with the drive assemblies and to rotate on a vertical axis thereby directing the vehicle to any of several chosen destinations; (c) motors or engines, bearings, clutches, switches, and proximity code reading devices necessary for the support, control and motion of the switching beam; and (d) interpreting and controlling computers necessary for the management and control of the switching beam.

Further in the preferred embodiment, the drive motors for the transit cars and the switch beam turntables preferably each have their output drive train equipped with a known electromagnetic rotating axis clutch which allows small controlling voltages such as that from a computer output to vary the throughput of the clutch according to a predetermined plan or from data received from scanners or proximity devices as interpreted by a computer or other logic system. Such a variable speed clutch allows controlled acceleration and deceleration of the vehicle or switch beam regardless of input motor or engine rotational speed.

As for the elevated or grade-level boarding stations of the transit system of the preferred embodiment, each may be equipped with (a) stairs, inclined ramps, elevators, or escalators to provide for passenger access to boarding levels; (b) automatic turnstile gates; (c) spaces for elevator machinery, automatic ticketing devices, automatic bank tellers, and automatic money changers; (d) complete safety barriers to protect people on platforms from contact with vehicles; (e) automatic devices to open access doors matching with the location of vehicle access doors, such access doors opening and closing in unison as provided by optical scanner and/or proximity detecting and control devices.

Various benefits which may be attained by use of the transit system of the preferred embodiment of the present invention include (a) lower cost of construction than passenger train systems, light rail systems, or other monorail systems; (b) savings of cost of rights-of-way acquisition since the system can run above existing roadways or railways; (c) all-weather operation since the top section of the beam protects the electrical power bars and drive wheel reaction surfaces from effects of weather; (d) softer, more comfortable ride for passengers since the vehicle ride is cushioned and hangs level regardless of the degree of torsional displacement of the drive assembly arms; (e) improved safety from automatic control of vehicle speed according to the requirements of the section of road beam that the vehicle is on; (f) lower cost operation since the arrangement of the components allows for the automated use of single monorail beam without a human being as operator; (g) lower cost of maintenance since the vehicle and the drive assembly are separable and components are interchangeable; (h) smoother acceleration and deceleration since the vehicle speed is controlled through a computer driven clutch; (i) greater safety to the passengers since the vehicle track may be elevated except in boarding stations where safety doors protect the passengers from vehicle contact; (j) lower cost of construction since the boarding station size need be proportional only to the length of a single vehicle which is limited; (k) better service to passengers since the controls permit short headways allowing one vehicle to follow another into boarding stations at short intervals, thereby minimizing waiting time to board; (l) more efficient use of capital since the cost of construction of the system described herein is substantially less than of other systems having the same passenger-moving capacity.

It should now be apparent that the side-mounted monorail transportation system as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. A monorail transit system, comprising:

a beam adapted to be supported on a ground-supported foundation, said beam having two opposite sides, at least one of which has respective truck means provided thereon;

a transit car body;

at least one transit car truck and a transit car guide means for each transit car body;

each said transit car truck and each said transit car guide means comprising a frame having first wheel means mounted thereon for rotation and disposed in rolling engagement with said track means for providing vertical support, and second and third wheel means mounted thereon for rotation and disposed in rolling engagement with said track means for providing horizontal support;

each said transit car truck and said transit car guide means further including an arm based on the respective said frame and arching upwardly and outwardly therefrom to an upper outer end at which a respective first securement means is provided;

each said transit car truck and said transit car guide means for each car body being spaced from one another longitudinally of the respective said track means;

each transit car body, above the center of gravity thereof having a plurality of second securement means provided thereon, said second securement means being spaced from one another longitudinally of the respective said transit car body;

each said second securement means being secured to a respective said first securement means for dependingly supporting each respective transit car body from said beam via a respective said at least one transit car truck and a respective said transit car guide means;

each said transit car truck further including motor means for powering one of said first and second wheel means for effecting transportation of each said transit car along the respective said track means of said beam.

2. The monorail transit system of claim 1, wherein:

for at least one of said at least one transit car, said transit car guide means being constituted by a further said transit car truck.

3. The monorail transit system of claim 1, wherein:

each said track means includes a first track surface which is spatially oriented so as to be upwardly facing and has said first wheel means disposed in rolling engagement therewith, and second and third track surfaces which are spatially oriented respectively above and below said first track surface so as to be respectively medially facing and laterally facing in relation to said beam and respectively have said second and third wheel means disposed in rolling engagement therewith.

4. The monorail transit system of claim 3, wherein:

said at least one transit car includes at least two said transit cars; and said beam has a said track means provided on each of said sides thereof.

5. The monorail transit system of claim 4, wherein:

said beam is of generally T-shaped transverse cross-sectional figure, having a base flange, a web and a head flange with serifs at opposite ends thereof, each said first track surface being provided on top of said base flange, each said second track surface being provided on a respective said serif of said head flange, and each said third track surface being provided on a respective outer end of said base flange.

6. The monorail transit system of claim 5, wherein:

at least one said second wheel means of each said transit truck means is a motor-driven wheel means; and said monorail transit system further includes for each said transit car body a power take-off means operatively connecting the respective said motor means with the respective said at least one second wheel means.

7. The monorail transit system of claim 6, wherein each said power take-off means incorporates a combination clutch/brake means for the respective said at least one second wheel means.

8. The monorail transit system of claim 7, wherein:

each said combination clutch/brake means is constituted by a magnetic particle clutch.

9. The monorail transit system of claim 5, wherein:

said head flange of said beam includes an upper surface adapted to provide an emergency catwalk for providing an escape route from a disabled said transit car for passengers thereof.

10. The monorail transit system of claim 6, wherein:

each said transit car body includes windows in sidewalls thereof including at least one escape exit window on one said sidewall, facing said catwalk, which window has a lower edge that is located at a level which is no lower than that of said catwalk.

11. The monorail transit system of claim 10, wherein:

each said transit car body includes sliding door means located in an opposite sidewall from said one sidewall, said sliding door being provided in a door opening having a sill which is flush with means providing a floor for the respective said transit car and which is located substantially below said lower edge of said escape exit window.

12. The monorail transit system of claim 1, wherein:

said second securement means pendularly support each respective car body from the respective said first securement means for swinging motion of the respective car body towards and away from said beam; and said monorail transit system further including, for each said transit car body, shock absorber means adapted to tend to maintain a datum degree of proximity of the respective said transit car body to said beam.

13. The monorail transit system of claim 12, wherein:

said shock absorber means includes toroidal air pillow means disposed between a respective said arm and a respective said transit car body about a respective said first and second securement means.

14. The monorail transit system of claim 12, wherein:

said shock absorber means includes an axially extensible/contractible strut-type shock absorber secured between the respective said car body and the respective said arm of the respective said transit car truck means.

15. The monorail transit system of claim 1, wherein:

said second securement means are adapted to be disconnected from said first securement means for disconnecting said at least one transit car body from said beam and for exchanging said at least one transit car truck and said transit car guide means for similar substitute transit car trucks and transit car guide means.

16. The monorail transit system of claim 1, wherein:

said beam is provided as a longitudinally extending series of sections aligned end-to-end, adjacent ends of said sections are oppositely tapered, flaring upwardly; a wedge of like profile to said sections is fitted between said ends; and splice plate means are provided, attached to said sections for holding each said wedge in place and providing strengthening continuity between the respective said adjacent ends.

17. The monorail transit system of claim 16, wherein:

said beam further includes an intersecting line of additional beam sections joined end to end in series; and a rotary turntable-type switch provided where said intersecting line intersects the first-described said beam.

* * * * *